US005141605A

United States Patent [19]

Nishino et al.

[11] Patent Number: 5,141,605

[45] Date of Patent: Aug. 25, 1992

[54] PROCESS FOR PRODUCING ALUMINUM SUPPORT OF A PRINTING PLATE

[76] Inventors: Atsuo Nishino; Tsutomu Kakei, both of c/o Fuji Photo Film Co., Ltd., No. 4000, Kawashiri, Yoshida-cho, Haibara-gun, Shizuoka, Japan

[21] Appl. No.: 265,164

[22] Filed: Oct. 31, 1988

[30] Foreign Application Priority Data

Oct. 30, 1987 [JP] Japan ..... 62-273546

[51] Int. Cl.[5] ..... C25F 3/04

[52] U.S. Cl. ..... 204/129.1; 204/129.4; 204/129.75

[58] Field of Search ..... 204/129.4, 129.46, 129.75, 204/DIG. 9, 129.1

[56] References Cited

U.S. PATENT DOCUMENTS

| | | | |
|---|---|---|---|
| 4,166,015 | 8/1979 | Raether | 204/129.75 |
| 4,272,342 | 6/1981 | Oda et al. | 204/129.75 X |
| 4,545,866 | 10/1985 | Ohba et al. | 204/129.43 |
| 4,561,944 | 12/1985 | Sasaki et al. | 204/129.43 X |
| 4,714,528 | 12/1987 | Takeuchi et al. | 204/129.46 X |
| 4,721,552 | 1/1988 | Huang et al. | 204/129.4 |

*Primary Examiner*—Donald R. Valentine

[57] ABSTRACT

An aluminum plate is subjected to electrochemical surface-roughening treatment etching treatment, and an additional electrochemical surface-roughening treatment in an acidic electrolyte, in the stated order. The electrochemical surface-roughening treatment is carried out in an electrolyte containing nitric acid by using alternating current. The resulting plate has excellent printing performance and long running characteristics.

4 Claims, 1 Drawing Sheet

PROCESS FOR PRODUCING ALUMINUM SUPPORT OF A PRINTING PLATE

BACKGROUND OF THE INVENTION

The present invention relates to a process for producing an aluminum support for a printing plate, and more particularly to a process for producing a printing plate support electrochemically—roughened so as to be suitable especially as an offset printing plate support.

Aluminum plates (including aluminum alloy plates) are employed as supports for printing plate especially as offset printing plate supports.

In general, an aluminum plate used as an offset printing plate member or support should have suitable adhesion and water retention properties as a photosensitive material.

In order to meet this requirement, the surface of the aluminum plate must be roughened in such a manner that it is uniformly and finely grained. The result of the surface roughening treatment will greatly affect the printing performance or service life of the printing plate member when it is used in an offset printing operation. Therefore, in the manufacture of a printing plate member it is critical to achieve the surface roughening treatment satisfactorily.

In general, an AC electrolytic etching method is employed to roughen the surface of a printing plate aluminum support. In the method, the current is an ordinary sinusoidal current, or a special alternating waveform current such as a square wave current. With AC current applied to a pair of electrodes which are, for instance, graphite, the surface of the aluminum plate is roughened. In general, the aluminum plate is only subjected to the surface roughening treatment once, and the depth of roughened surface therein are small over the entire surface, and accordingly the aluminum plate is insufficient to ensure good running characteristics. Therefore, a variety of methods have been proposed in the art to manufacture an aluminum plate suitable as support for a printing plate which is grained in such a manner that the depth of roughened surface are relatively large with respect to the diameter thereof and are distributed uniformly and closely.

The proposals made so far are based on optimizing parameters such as the ratio of electricity to be applied respectively to the anode and the cathode during electrolytic roughening with a-c current (Japanese Unexamined Patent Application (OPI) No. 65607/1979); the waveform of the voltage which is supplied from a power source (Japanese Unexamined Patent Application (OPI) No. 25381/1980); and combinations of variable currents to be applied per unit area (Japanese Unexamined Patent Application (OPI) No. 29699/1981).

In addition, the combination of a mechanical surface-roughening method and an electrochemical surface roughening method has been disclosed by Japanese patent Application Publication No. 16918/1982.

Despite such efforts, however, the depth of roughened surface produced by these prior art techniques are not sufficiently large and have such uneven depth profiles so as to provide a complexly undulating pattern. Not surprisingly, therefore, offset printing plates made by using aluminum supports having such defective pits are far from being satisfactory in terms of both printing performance and running characteristics.

Accordingly, an object of this invention is to provide aluminumsupport for a printing plate which is roughened in such a manner that the pits formed are greater in depth than in diameter and distributed uniformly and closely such that the plate has excellent printing performance and satisfactory running characteristic in an offset printing operation.

SUMMARY OF THE INVENTION

According to the invention, an aluminum plate is subjected to surface-roughening, etching, and surfaceroughening respectively in the stated order, whereby the grain formed thereon can be effectively shaped, and therefore the after-treatment can be eliminated. That is a surface-roughened aluminum plate suitable as an aluminum support for a printing plate having a dual grain structure where grains, greater in depth than in diameter, honey-comb-shaped, uniform, round and overlapped, can be manufactured efficiently by a method in which the electrolytic surface-roughening treatment is carried out in an electrolyte containing nitric acid by using AC current, wherein the edges of pits formed by the electrolytic surface-roughening treatment are molten. That is, the edges of the pits are smoothed, and thereafter the electrolytic surface-roughening treatment in the electrolyte containing nitric acid by using AC current is repeated.

That is, the invention provides a process for producing aluminum support for a printing plate in which, an aluminum plate is subjected to electrochemical surfaceroughening treatment in an acidic electrolyte, and is subjected to the same electrochemical surface-roughening treatment again after being subjected to etching treatment.

It is preferable that the electrolyte for electrochemical surface-roughening treatment in the invention be an aqueous solution essentially containing nitric acid.

DETAILED DESCRIPTION OF THE PREFERRED EMBODIMENT

In the electrochemical surface-roughening treatment in the acidic electrolyte according to the invention, AC current is supplied to an aluminum plate and an electrode which are disposed in an electrolyte containing, for instance, nitric acid. It is preferable that the electrolyte be an aqueous solution containing nitric acid in a ratio of 5 to 400 g/l, the current density be 1 to 200 A/dm$^2$, the solution temperature be in a range of from 30° C. to 80° C., and the electrolytic surface-roughening time be in a range of from 5 sec. to 90 sec.

Figure 2A:
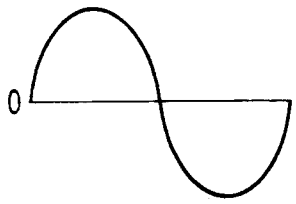
Figure 2B:
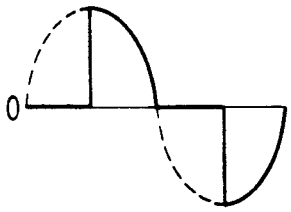
Figure 2C:
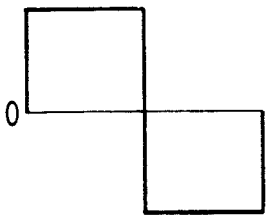

The waveform of the Ac current is such that the positive and negative voltages appear alternately. Examples of the waveform are as shown in parts (a), (b) and (c) of FIG. 2. More specifically, part (a) of FIG. 2 shows a sine wave, part (b) a sinusoidal wave phase-controlled with a thyristor, and part (c) a square wave. However, it should be noted that the waveform of the AC current is not limited to those shown in parts (a) through (c) of FIG. 2.

The electrolyte for electrochemical surface-roughening treatment is not limited to one containing nitric acid; that is, it may be an electrolyte containing hydrochloric acid, hydrochloric acid and nitric acid, or nitric acid and sulfuric: acid. In this connection, instead of sulfuric acid, phosphoric acid and sulfuric acid, or phosphoric acid and another acid may be used.

The etching treatment carried out after the first electrochemical surface-roughening treatment is designed to melt the edges of the pits formed in the first electrochemical surface-roughening treatment. For this purpose, a variety of conventional etching methods may be used, such as a method of immersing an aluminum plate in a high-temperature sulfuric acid solution for a long period of time, a method of immersing an aluminum plate in a caustic soda solution, and a method of electrically polishing an aluminum plate in a phosphoric acid or sulfuric acid electrolyte. However, care must be taken that, after the electrochemical surface-roughening treatment, the etching solution and the electrochemical surface-roughening solution may not be mixed together.

According to the invention, the electrochemical surface-roughening treatment may be carried out many times. However, for the purpose of simplifying the manufacture, it is preferable that the electrochemical surface-roughening treatment be carried out twice. That is, the electrochemical surface-roughening treatment, the etching treatment, and the electrochemical surface-roughening treatment should be applied to the aluminum support in the stated order.

As was described above, after the etching treatment, the electrochemical surface-roughening treatment is carried out again. In the electrochemical surface-roughening treatment, it is preferable that the electrolyte be an aqueous solution containing nitric acid at a ratio of 5 to 400 g/l, the current density be 1 to 200 A/dm$^2$, the solution temperature be in a range of from 30° C. to 80° C., and the electrochemical surface-roughening time be in a range of from 5 sec to 90 sec. Thus, a dual pit structure grain having fine, round, uniform and honey-comb-shaped pits formed in a grain having deep pits is formed on the surface of the aluminum plate.

The aluminum plate thus treated ma be further treated as follows, when required: The aluminum plate may be slightly etched in an aqueous solution containing acid or alkali at a room temperature of up to 90° C., and then subjected to neutralizing treatment. For the purpose of slightly etching the aluminum plate, an immersing method or an electrochemical method such as electrolytic polishing may be employed. The slightly etching of the aluminum plate will provide a printing plate support excellent in characteristic.

The pretreatment of the aluminum plate which is normally carried out for electrochemical surface-roughening (i.e., degreasing the aluminum plate with acidic or alkaline solution) may be carried out if necessary.

If the etching treatment provided between the first and second electrochemical surface-roughening treatments in the invention, were not carried out, then the resultant grain would be intricate and non-uniform in configuration, and the scumming and tinting characteristic would not be good without the after-treatment.

The surface-roughened aluminum plate is subsequently subjected to anodic oxidation in an electrolyte containing sulfuric acid or phosphoric acid according to the conventional method, so that a printing plate support having excellent hydrophilic, water retentivity, and plate wear characteristics is manufactured. After the anodic oxidation treatment, the aluminum plate may be subjected to hydrophilic treatment by immersing it in an aqueous solution containing, for instance, silicate of soda.

The electrolytic method of the invention is applicable to a batch process, semi-continuous process, and continuous process.

EXAMPLES

The following are examples of the process for producing aluminum support for printing plate according to the invention. However, it should be noted that the invention is not limited thereto or thereby.

EXAMPLE 1

Figure 1:
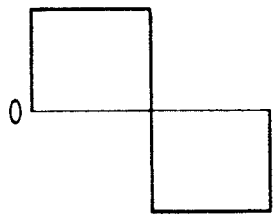
FIGS. 1 and 2*a*–2*c* are diagrams showing examples of the voltage waveform of an AC current employed in the invention.

A JIS 1050 - H16 aluminum plate was immersed in a 5% caustic soda solution at 50° C. for 30 sec. and washed. The aluminum plate thus treated was subjected to electrochemical surface-roughening treatment in an aqueous solution containing nitric acid at a ratio of 15 g/l at a temperature of 40° C. for 20 sec. with a current density of 40 A/dm$^2$. In this operation, the current used was a square waveform as shown in FIG. 1. Thereafter, the aluminum plate, after being washed with water, was immersed in a 5% caustic soda solution for 10 sec. so that the pit edges formed by the electrochemical surface-roughening were molten, and the aluminum plate thus treated was washed with water. Subsequently, the aluminum plate was subjected to electrolytic etching in the solution containing nitric acid at a ratio of 15 g/l at a temperature of 40° C. with a current density of 40 A/dm$^2$ for 5 sec. The smut essentially containing aluminum hydroxide deposited on the surface of the aluminum plate was removed by immersing it in a solution containing sulfuric acid at a rate of 250 g/l at a solution temperature of 50° C. for 30 sec. The aluminum plate was then washed with water.

The aluminum plate thus surface-roughened has a uniform and close dual structure grain 0.7 μm in average surface roughness with fine round honey-comb-shaped pits formed thereon. The aluminum plate thus treated was further subjected to anodic oxidation in a solution containing sulfuric acid at a ratio of 100 g/l so that the quantity of oxide film on the aluminum plate be 3 g/m$^2$. The aluminum plate thus formed was coated with a photosensitive layer resulting in the completed printing plate. The printing plate thus formed had excellent printing performance, long running characteristics, low scumming or tinting.

EXAMPLE 2

An aluminum plate was treated in the same manner as in Example 1 except that it was not cleaned with caustic sode as a pretreatment. The aluminum plate thus treated was used to manufacture a printing plate. The aluminum plate had the same grain structure as that in Example 1. Thus, even though the pretreatment was omitted, the grain formed was still uniform.

EXAMPLE 3

A JIS 1050 - H16 aluminum plate was subjected to electrolytic etching in a solution containing nitric acid at a ratio of 15 g/l. at a temperature of 40° C. for 20 sec. with a current density of 40 A/dm$^2$. In this operation, the current was a square waveform, as shown in FIG. 1. The aluminum plate thus treated was washed with water and immersed in a solution containing sulfuric acid at a ratio of 400 g/l. at a temperature of 90° C. for 120 sec. so that the edges of pits formed by the electrochemical surface-roughening treatment were molten.

Thereafter, the aluminum plate was washed with water. The aluminum plate was then subjected to electrolytic etching in the solution containing nitric acid at a ratio of 15 g/l, at a temperature of 40° C. for 5 sec. with a current density of 40 A/dm$^2$. The smut essentially containing aluminum hydroxide deposited on the surface of the aluminum plate thus treated was removed by immersing the plate in a solution containing sulfuric acid at a ratio of 250 g/l, a solution temperature of 50° C., and the plate was then washed with water. The aluminum plate thus surface-roughened has a uniform and close dual structure grain 0.7 μm in average surface roughness with the fine round honey-comb-shaped pits formed thereon. Thereafter, the aluminum plate was further subjected to anodic oxidation in a solution containing sulfuric acid at a ratio of 100 g/l so that the quantity of oxide film on the aluminum plate was 3 g/m$^2$. A photosensitive layer was coated on the thus treated aluminum plate, resulting in a printing plate. The resultant printing plate had excellent printing performance, long running characteristics, and low scumming or tinting.

As was described above, the specific feature of process for producing the aluminum support for printing plate according to the invention resides in that an aluminum plate is subjected to electrochemical surface-roughening treatment, etching treatment and electrochemical surface-roughening treatment respective by in the stated order. Therefore, in the process of the invention, the edges of the pits formed by the first electrochemical surface-roughening treatment are molten by the etching treatment so that they do not adversely affect the manufacture of a printing plate. The second electrochemical surface-roughening treatment forms fine, round, uniform and honey-comb-shaped pits on the wavy grain formed by the first electrochemical surface-roughening treatment. A dual pit structure grain having a desired depth can be readily formed by combination of the conditions of the first and second electrochemical surface-roughening treatments. The grains are greater in depth than in pitch, and well shaped, and have a number of peaks substantially equal in level. The small pits are closely distributed, and are regularly round.

An offset printing plate manufactured by using the aluminum plate surface-roughened according to the invention has excellent printing performance, low scumming or tinting and long running characteristics.

What is claimed is:

1. A process for producing aluminum support for a printing plate, comprising the step of:

subjecting an aluminum plate to electrochemical surface-roughening treatment, etching treatment, and electrochemical surface-roughening treatment in an acidic electrolyte, in the stated order, the acidic electrolyte used in said electrochemical surface-roughening treatment before said etching treatment being the same as said acidic electrolyte used after said etching treatment.

2. The process claimed in claim 1, wherein said acidic electrolyte is an aqueous solution essentially containing nitric acid.

3. The process claimed in claim 1, wherein said subjecting steps comprises disposing the aluminum plate and an electrode in said acidic electrolyte and applying alternating current to said plate and said electrode.

4. The process claimed in claim 1, further comprising the step of subjecting said aluminum plate to a desmutting treatment in a solution containing sulfuric acid in the stated order.

* * * * *